United States Patent [19]

Kuhn

[11] 3,944,748

[45] Mar. 16, 1976

[54] MEANS AND METHOD OF REDUCING INTERFERENCE IN MULTI-CHANNEL REPRODUCTION OF SOUNDS

[75] Inventor: Hans-Robert Kuhn, Kiel, Germany

[73] Assignee: Electroacustic GmbH, Kiel, Germany

[22] Filed: Oct. 31, 1973

[21] Appl. No.: 411,278

[30] Foreign Application Priority Data

Nov. 2, 1972 Germany ..... 2253696

[52] U.S. Cl. ..... 179/15 BT; 179/1 G

[51] Int. Cl.[2] ..... H04H 5/00

[58] Field of Search 179/1 G, 1 GQ, 15 BT, 100.4 ST, 179/100.1 TD, 1 P

[56] References Cited

UNITED STATES PATENTS

| | | | |
|---|---|---|---|
| 3,539,729 | 11/1970 | Von Recklinghausen | 179/15 BT |
| 3,673,342 | 6/1972 | Muller | 179/15 BT |
| 3,745,254 | 7/1973 | Ohta | 179/1 GQ |
| 3,753,159 | 8/1973 | Burwen | 179/1 P |
| 3,786,193 | 1/1974 | Tsurushima | 179/1 GQ |
| 3,823,268 | 7/1974 | Modafferi | 179/15 BT |

*Primary Examiner*—William C. Cooper
*Assistant Examiner*—George G. Stellar
*Attorney, Agent, or Firm*—Herbert L. Lerner

[57] ABSTRACT

Means and method of reducing the distortion or channel separation due to interference voltages between the reproduction channels in multi-channel reproduction of acoustic sounds in systems having at least two different channels are described. The steps are deriving a control voltage from the low and high interference voltages which occurs in a channel which is proportional to the magnitude of the interference voltages, and using the control voltages as an adjustment to control the distortion or channel separation. The control voltages may be derived from a single channel. The control voltages may be combined to yield a single control signal. Both equal-phase distortion and phase-opposition distortion may be suppressed.

8 Claims, 2 Drawing Figures

MEANS AND METHOD OF REDUCING INTERFERENCE IN MULTI-CHANNEL REPRODUCTION OF SOUNDS

The present invention relates to means and methods of reducing distortion, channel separation or crosstalk loss between the reproduction channels in multichannel reproduction of acoustic programs by reducing the interference voltages, i.e. static.

Some means are known to reduce distortion. The control parameter in one instance is the amplitude of the receiver input voltage. When a predetermined amplitude minimum of the receiver input voltage level is not reached the output of the distortion is automatically reduced to a fixed value. However, this does not take into account the actual level of the respectively present interference voltages, since it can occur even when no interference voltage is present.

It is also known, in stereo receivers which receive separate main and auxiliary signals, to constantly vary the distortion output in dependence on the received field intensity. The distortion is reduced only as much as is required for a noiseless reception of a stereo broadcast. A control regulating voltage which depends on the field intensity is obtained which accordingly weakens the stereo auxiliary signal which produces the stereo directional effect. This continuous weakening of the stereo auxiliary signal is undesirable.

These known methods for an automatic and also a continuous variation of the distortion have the disadvantage that they can be employed only for stereo reproduction devices which are equipped with a high frequency portion.

For recovering the full stereo effect which has also been worsened by the reduction of the distortion, it is also known to feed a portion of the useful modulation of the one channel into the other channel, and vice versa.

In the present invention, in order to improve the stereo directional effect to equalize what has been lost through the reduction of the distortion between the reproduction channels, a feature of the invention provides that purely phase-opposed control voltages proportional to the magnitude of the obtained control voltage, are continuously applied to said channels.

Accordingly, a principal object of this invention is to provide means and methods which make it possible to obtain control voltages for constantly varying the distortion, in stereo apparatuses.

Another object of the invention is to provide new and improved means and methods which make it possible to obtain control voltages for constantly varying the distortion, in stereo apparatuses without a high frequency part such as, recording tapes and record players.

Another object of the invention is to provide a new and improved method of reducing distortion between the reproduction channels in multi-channel reproduction of acoustic sounds in systems having at least two different channels by reducing the interference voltages, comprising the steps of deriving control voltages from and proportional to the interference voltages which occur in a low frequency channel, and applying the control voltages to these channels to control the distortion.

In the present invention, these objectives are solved by deriving from the interference voltage which occurs in the low frequency channels a control voltage which is proportional to the magnitude of the interference voltage and using this control voltage as an opposing variation of the distortion thereby reducing the channel separation by adding crosstalk. The invention does not aim to reduce the crosstalk i.e. increase the channel separation. On the contrary, the channel separation is reduced in order to bring together the interference voltages which are present in both channels in phase opposition and to thereby suppress the interference voltages.in proportion to the thereby occurring reciprocal quenching.

The means and modes of operation of the invention will now be described with reference to the drawings, of which:

Figure 1:
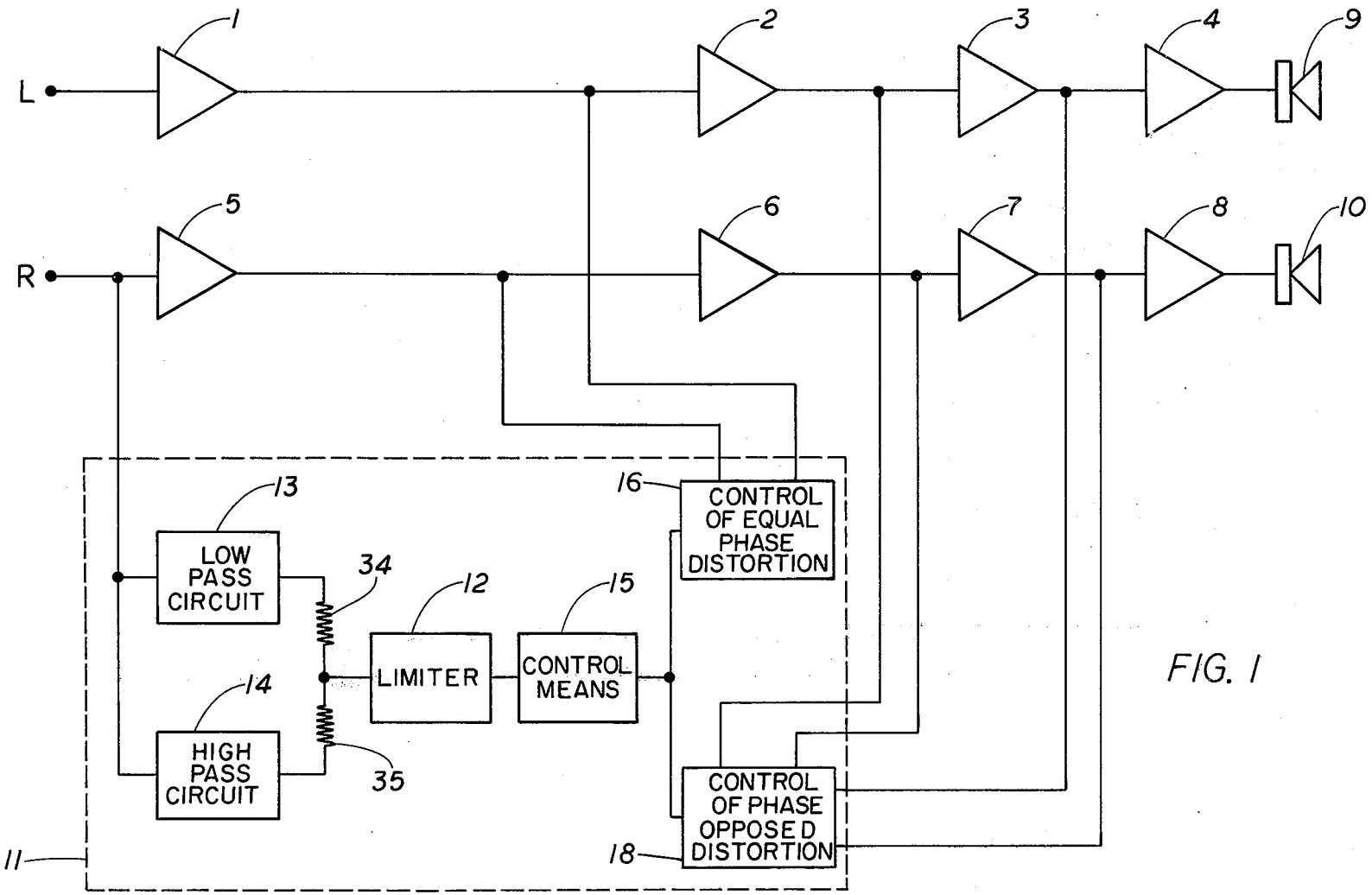
FIG. 1 is a block circuit diagram of an embodiment of the invention.

In the circuit diagram of FIG. 1, the demodulated and decoded stereo signals in the stereo channels L and R, are supplied, via amplification stages, 1, 2, 3 and 4, respectively and 5, 6, 7 and 8, respectively, to the loud speakers 9 or 10. Assembly 11, denotes the aforementioned control circuit from which is fed a portion of the demodulated and decoded stereo signal of one channel R and which is utilized for controlling, between the stereo channels L and R, an equal-phase or in-phase distortion at the input of an amplification stage, and a phase-opposed distortion at the input of one of the following amplification stages.

The control circuit 11 comprises an amplitude limiting device 12 with an amplitude limit, which lies approximately at the highest expected amplitude of the interference voltage. Limiting device 12 is coupled to a low pass circuit 13 and to a high pass circuit 14, which function for filtering the frequency ranges wherein the interference voltages, predominantly occur. The outputs of low pass circuit 13 and high pass circuit 14 are decoupled from each other through the two resistors 34 and 35. Adjacent to the amplitude limiting device 12, is provided a control device 15 whose output is connected, firstly, to the control member 16 for varying the equal-phase or in-phase distortion and is connected secondly, with control member 18, for varying the phase-opposed distortion.

Figure 2:
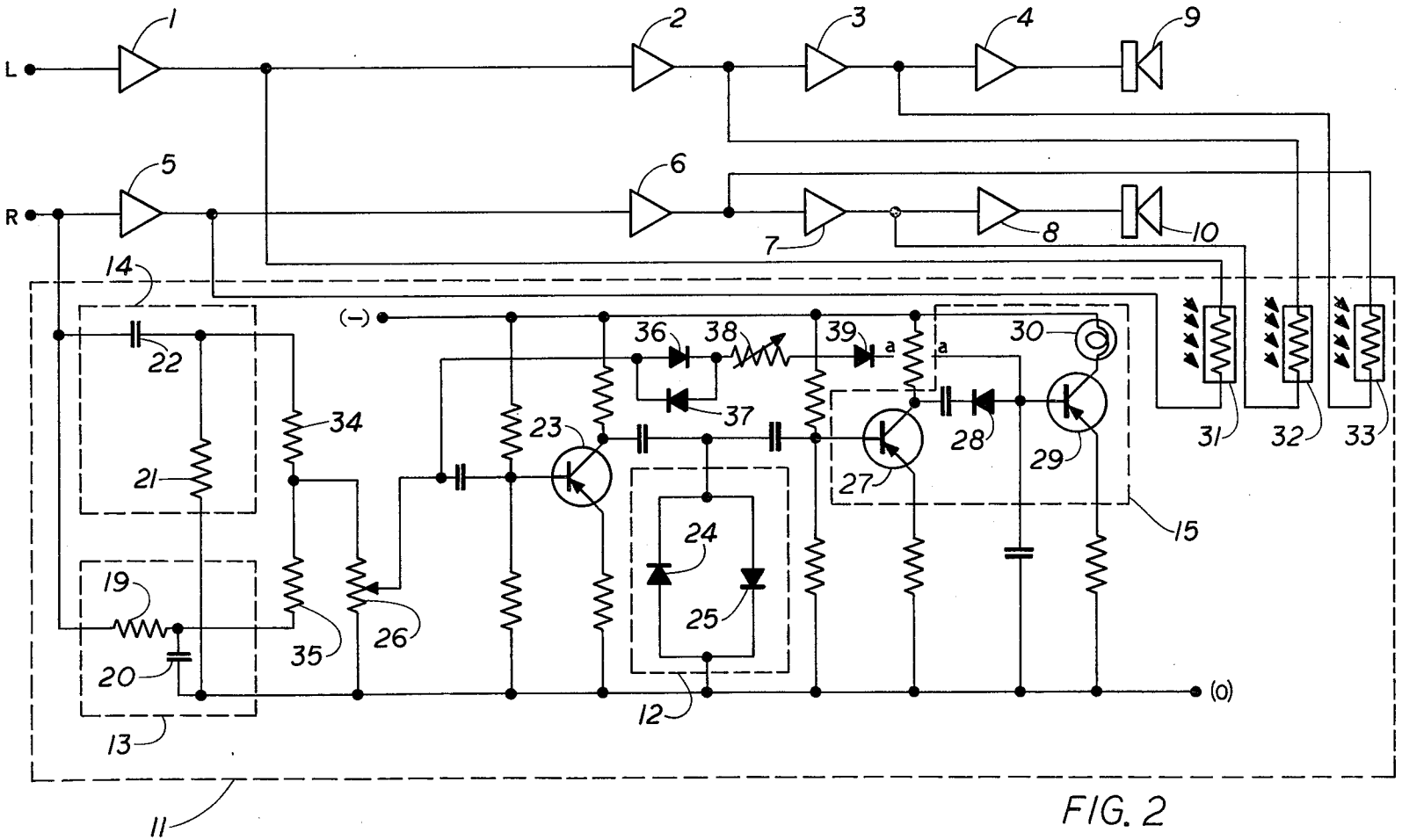
FIG. 2 is a schematic circuit diagram of the embodiment of the invention of FIG. 1.

FIG. 2 shows a schematic circuit diagram of this control circuit 11 in FIG. 1. The same components in both Figures are identified by the same reference numerals.

The low frequency voltage derived from the one stereo channel R is supplied to the low pass circuit 13, which comprises the members R 19, C 20 and to the high pass circuit 14, which comprises the members R 21 and C 22. Resistors 34 and 35 denote the decoupling resistors. The frequencies admitted by low pass 13 and high pass 14, are amplified by the transistor 23 and are, subsequently, supplied to the amplitude limiting device 12, which comprises the two anti-parallel or back-to-back diodes 24 and 25. Since the limiting voltage of these diodes 24 and 25 is unchangeably fixed, and thus, not adjustable, the adjustment is effected by adjusting the voltage supplied to these diodes 24 and 25, by means of the potentiometer 26, which is connected in series with the base of transistor 23.

From the amplitude limiting device 12, the voltage is supplied to the control device 15, consisting of a transistor 27, a diode 28, another transistor 29 and the lamp 30 connected thereto. The transistor 27 amplifies the voltage which is, subsequently, rectified through the diode 28, so that a negative voltage is applied to the base of the transistor 29. Depending on the magnitude of the voltage, which corresponds to the magnitude of the interference signal, the transistor 29 is controlled more or less strongly conductive, and thereby, the lamp 30 also is controlled correspondingly brighter or darker.

The brightness of the lamp 30 affects, firstly, the photo resistance 31, which is the control member 16, in FIG. 1 and affects also, the photo resistors 32 and 33 which are the control means 18, in FIG. 1. With an increase in brightness of the lamp 30, meaning with an increase in the interference level, the photoresistors 31, 32 and 33 become less resistive, which decreases the distortion between the reproduction channels L and R.

The photo resistor 31 is used to control the equal-phase distortion between the channels L and R, while photo-resistor 32 is used to control the phase-opposition distortion of channel R into channel L and photo resistor 33 is used for controlling the phase-opposition distortion of channel L into channel R. Photo-resistors 32 and 33 therefore perform a dual phase-opposed distortion suppression.

In order to prevent those signals whose amplitude is higher than the highest to be expected from producing a negative voltage at the base of the transistor 29, whereby the distortion muffling is unnecessarily reduced in this instant, a parallel channel is provided with the two anti-parallel diodes 36 and 37, the control resistor 38 and the diode 39. The connection *a* - *a* is shown broken so as not to interfere with the intervening resistor. These two anti-parallel diodes 36 and 37 are so rated that only such voltages are admitted whose amplitude is higher than the highest feasible interference voltage amplitude and that from these admitted voltages, a positive DC voltage is derived, which voltage compensates the supplied negative DC voltage.

I hereby claim:

1. Method of suppressing interference voltages in multi-channel reproduction of acoustic sounds in systems having at least two different channels by reducing the channel separation, comprising the steps of, deriving control voltages from and proportional to low and high frequency interference voltages, respectively, which occur in one of said channels, and utilizing said control voltages to control the channel separation in both a phase-opposite sense and in an equal phase sense to thereby suppress the interference.

2. A method of suppressing interference voltages in multi-channel reproduction of acoustic sounds in systems having at least two different channels by reducing the channel separation, comprising the steps of, separately deriving control voltages from and proportional to the low and high frequency interference voltages from a single one of said channels, combining the separately derived control voltages to produce a control signal, and utilizing said control signal to control the channel separation in a dual phase-opposite sense to thereby suppress the interference.

3. Method according to claim 2, including the step of deriving the control voltages that are proportional to the magnitude of the interference voltages, and simultaneously and continuously providing purely phase-opposed crosstalk between said channels by said control signal.

4. A device for suppressing low and high frequency interference voltages in multi-channel reproduction systems of acoustic sounds having at least two different channels by reducing channel separation, comprising a low pass filter and a high pass filter for deriving control voltages respectively proportional to the low and high frequency interference voltages from a single one of said channels, means for combining the separately derived control voltages to produce a control signal, and control means responsive to said control signal for controlling the channel separation in said channels in a dual phase-opposite sense.

5. A device for suppressing low and high frequency interference voltages in multi-channel reproduction systems of acoustic sounds having at least two different channels by reducing channel separation, comprising means for deriving control voltages, respectively, proportional to the low and high frequency interference voltages from the interference voltages which occur in one of said channels, and control means connected to the voltage deriving means to control the channel separation in said channels in both a phase-opposite sense and in an equal-phase sense.

6. The device as in claim 5, wherein said channels each have at least first and second amplifiers, said control voltages being derived from one of said channels, and comprising low pass filter means and high pass filter means connected to receive said interference voltages from said one of said channels, limiter means connected to the output of said low pass and high pass filter means, control means connected to the output of said limiter means, first, second and third photo-resistor means optically connected to the output of said control means, the first photo-resistor means being connected to the inputs of the first amplifiers, the second photo-resistor means being connected to the output of said second amplifier in said one of said channels and to the output of the first amplifier in the other channel, the third photo-resistor being connected to the output of the first amplifier in said one of said channels and to the output of the second amplifier in said other channel.

7. The device as in claim 5, wherein said means for deriving control voltages comprises a low pass filter and a high pass filter connected to receive said interference voltages from the same channel, and means for interconnecting the outputs of said filters and feeding said control means.

8. The device as in 7, further comprising means for adjusting the amplitude of the feed to said control means.

* * * * *